US009451661B2

(12) United States Patent
Jao et al.

(10) Patent No.: US 9,451,661 B2
(45) Date of Patent: Sep. 20, 2016

(54) LINEAR LED DRIVER AND CONTROL METHOD THEREOF

(71) Applicant: Richtek Technology Corporation, Zhubei, Hsinchu County (TW)

(72) Inventors: Tong-Cheng Jao, Taichung (TW); Yi-Wei Lee, Taipei (TW); Jiun-Hung Pan, Taipei (TW); Isaac Y. Chen, Jubei (TW)

(73) Assignee: RICHTEK TECHNOLOGY CORP., Zhubei, Hsinchu County (TW)

( * ) Notice: Subject to any disclaimer, the term of this patent is extended or adjusted under 35 U.S.C. 154(b) by 0 days.

(21) Appl. No.: 15/018,309

(22) Filed: Feb. 8, 2016

(65) Prior Publication Data

US 2016/0242245 A1 Aug. 18, 2016

(30) Foreign Application Priority Data

Feb. 12, 2015 (TW) ..... 104104844 A

(51) Int. Cl.
*G05F 1/00* (2006.01)
*H05B 33/08* (2006.01)

(52) U.S. Cl.
CPC ..... *H05B 33/0812* (2013.01); *H05B 33/0845* (2013.01)

(58) Field of Classification Search
USPC ..... 315/291, 307, 308, 246, 247
See application file for complete search history.

(56) References Cited

U.S. PATENT DOCUMENTS

| | | | | |
|---|---|---|---|---|
| 8,698,407 | B1 | 4/2014 | Chen et al. | |
| 8,723,431 | B2 | 5/2014 | Deppe et al. | |
| 9,210,744 | B2 * | 12/2015 | Del Carmen, Jr. et al. | H05B 33/0809 |
| 2008/0048573 | A1 | 2/2008 | Ferentz et al. | |
| 2008/0106216 | A1 | 5/2008 | Yu et al. | |
| 2008/0203934 | A1 | 8/2008 | Van Meurs | |
| 2012/0242252 | A1 | 9/2012 | Yang et al. | |
| 2014/0239849 | A1 * | 8/2014 | Del Carmen, Jr. et al. | H05B 33/0815 315/307 |
| 2014/0333228 | A1 | 11/2014 | Angeles et al. | |
| 2015/0181666 | A1 | 6/2015 | Muesch | |

FOREIGN PATENT DOCUMENTS

TW 201146087 A 12/2011

* cited by examiner

*Primary Examiner* — Minh D A
(74) *Attorney, Agent, or Firm* — Muncy, Geissler, Olds & Lowe, P.C.

(57) ABSTRACT

A linear LED driver includes a voltage supply terminal providing a driving voltage, at least one first transistor, each of which has an input terminal coupled to a respective LED, and a bleeder circuit. When the voltage of the output terminal of each of the at least one first transistor is lower than a first threshold and a power voltage is higher than a second threshold, the bleeder circuit will generate a bleeder current to discharge the voltage supply terminal so as to prevent the LEDs from flickering. The bleeder circuit detects the voltage of the output terminal of each of the at least one first transistor. Therefore, whether the LEDs are lighted up can be confirmed so that the bleeder current can be provided at properly time point.

16 Claims, 14 Drawing Sheets

LINEAR LED DRIVER AND CONTROL METHOD THEREOF

CROSS-REFERENCE TO RELATED APPLICATIONS

This application claims the priority benefit of Taiwan Application No. 104104844, filed Feb. 12, 2015, the contents of which in its entirety are herein incorporated by reference.

FIELD OF THE INVENTION

The present invention is related generally to a linear light emitting diode (LED) driver and control method and, more particularly, to a linear LED driver and a control method thereof that can prevents LEDs from flickering.

BACKGROUND OF THE INVENTION

LED drivers can be generally classified into isolated type and non-isolated type. A LED driver of isolated type needs a transformer to isolate the primary side from the secondary side, and thus requires higher costs. A LED driver of non-isolated type needs lower costs due to absence of the transformer, while flickering in triode alternating current (TRIAC) dimming applications.

FIG. 1 shows a conventional linear LED driver 10 of non-isolated type, which includes a bridge rectifier 12 to rectify an alternating current (AC) voltage Vac to generate a driving voltage VIN for providing to LEDs 2, 4, 6, and 8 via a voltage supply terminal 16, and an integrated circuit (IC) 14 to control the LEDs to be lighted. In the IC 14, switches 18, 20, 22, and 24 are serially connected to the LEDs 2, 4, 6, and 8 via pins S1, S2, S3, and S4, respectively. FIG. 2 shows waveforms of signals generated by the circuit shown in FIG. 1, in which the waveform 26 represents the driving voltage VIN, and the waveforms 28, 30, 32, and 34 represent the voltages of the pin S1, S2, S3, and S4, respectively. When the driving voltage VIN increases to be higher than the forward bias Vf1 of the LED 2, the LED 2 will be turned on, so that the voltage of the pin S1 rises as shown by the waveform 28 and thereby the switch 18 will be turned on and lights up the LED 2. When the driving voltage VIN becomes higher than the sum Vf1+Vf2 of the forward biases of the LEDs 2 and 4, the LEDs 2 and 4 will be turned on, so that the voltage of the pin S2 rises as shown by waveform 30 and accordingly the switch 20 will be turned on for lighting up the LEDs 2 and 4. When the driving voltage VIN becomes higher than the sum Vf1+Vf2+Vf3 of the forward biases of the LEDs 2, 4, and 6, the LEDs 2, 4, and 6 will be turned on, so that the voltage of the pin S3 rises as shown by waveform 32 and accordingly the switch 22 will be turned on for lighting up the LEDs 2, 4, and 6. When the driving voltage VIN becomes higher than the sum Vf1+Vf2+Vf3+Vf4 of the forward biases of the LEDs 2, 4, 6, and 8, the LEDs 2, 4, 6, and 8 will be turned on, so that the voltage of the pin S4 rises as shown by waveform 34 and accordingly the switch 24 will be turned on for lighting up the LEDs 2, 4, 6, and 8.

FIG. 3 shows a conventional TRIAC dimmer 44, which comprises resistors R1 and R2, a capacitor C1, a bidirectional trigger diode (DIAC) 46, and a TRIAC switch 48. The resistor R2 adopts a variable resistor. At the beginning, the TRIAC switch 48 is in an off-state. Namely, the AC voltage Vac is not applied to a load. The resistors R1 and R2 generate a current to charge the capacitor C1 according to the AC voltage Vac. When the voltage at the capacitor C1 reaches a breakover voltage of the DIAC 46, the DIAC 46 will be turned on and thus turn on the TRIAC switch 48. When the TRIAC switch 48 is turned on, the AC voltage Vac is applied to the load, and the capacitor C1 starts discharging. The TRIAC switch 48 keeps in the on-state until the AC voltage becomes zero or until a current I1 that passes the TRIAC switch 48 is lower than a threshold. That is to say, the TRIAC dimmer converts the AC voltage Vac into an AC phase-cut voltage Vtr with a conduction angle. Wherein, the AC phase-cut voltage Vtr will be rectified by the bridge rectifier 12 in FIG. 1 to generate the driving voltage VIN as shown by the waveform 50 in FIG. 3. However, when the TRIAC switch 48 is turned off, the capacitor C1 provides a coupling path, so that the driving voltage VIN occurs an undesired variation as shown by an area 54 of the waveform 52 and an area 58 of the waveform 56 in FIG. 4. The waveform 52 represents the driving voltage VIN generated by the TRIAC dimmer 44 that is a leading edge dimmer, and the waveform 56 represents the driving voltage VIN generated by the TRIAC dimmer 44 that is a trailing edge dimmer. Such undesired variation may shortly turn on the LED which should have been turned off and easily cause the flickering on the LED.

U.S. Pat. Nos. 8,723,431 and 8,698,407, and U.S. Patent Publication No. 2008/0203934 utilize a bleeder circuit to draw a bleeder current for discharging the driving voltage VIN, thereby avoiding the undesired variation so as to solve the flickering problem. As shown by the area 54 of the waveform 52 and the area 58 of the waveform 56 in FIG. 5, the undesired variations of the voltages are eliminated by the bleeder current. However, the driving voltage VIN is a high voltage, so the existing bleeder circuits need extra high-voltage components or pins. As a result, the related costs are higher. Moreover, these methods set a fixed threshold and generate the bleeder current when the driving voltage VIN is lower than the fixed threshold. Nonetheless, the forward biases Vf1, Vf2, Vf3, and Vf4 of the LEDs 2, 4, 6, and 8 are not fixed. Thus, the fixed threshold is difficult to be defined. Referring to FIG. 2, when the fixed threshold is too high as shown by the waveform 36, the bleeder current Ibd will be generated when the LED is still lighted as shown by the waveform 40, which adversely results in a low efficiency. Oppositely, when the fixed threshold is too low as shown by the waveform 38, the bleeder current Ibd will not be generated until the LED is turned off for a while as shown by the waveform 42, which probably results in the flickering.

SUMMARY OF THE INVENTION

An objective of the present invention is to provide a linear LED driver that prevents the LED from flickering and a method thereof.

Another objective of the present invention is to provide a linear LED driver that avoids generating a bleeder current during the LED turned on and a method thereof.

A further objective of the present invention is to provide a linear LED driver that includes a bleeder current but gets rid of high-voltage components as well as pins and a method thereof.

According to the present invention, a linear LED driver comprises at least one first transistor, a voltage supply terminal for providing a driving voltage to drive LEDs, a voltage regulator, and a bleeder circuit. Each of the at least one first transistor has an input terminal coupled to the LEDs and lights up or turns off the LEDs. The voltage regulator is coupled to the voltage supply terminal and is converting the driving voltage into a power voltage used by the LED driver. The bleeder circuit detects a voltage of the output terminal of each the at least one first transistor and the power voltage. The bleeder circuit generates a bleeder current that flows through the voltage regulator when a voltage of the output terminal of each the at least one first transistor is lower than a first threshold and the power voltage is higher than a second threshold, thereby preventing the LEDs from flickering. Wherein, the voltage regulator is an original part built in the linear LED driver. Moreover, the voltage regulator also requires a high-voltage component to bear the driving voltage on the voltage supply terminal. Thus, the bleeder circuit that draws a current from the voltage supply terminal via the voltage regulator doesn't need extra high-voltage components or pins. Additionally, the bleeder circuit detects the voltage of the output terminal of each the at least one first transistor, so that whether the LEDs are lighted can be confirmed, and the bleeder current can be prevented from being generated during the LED turned on.

According to the present invention, a linear LED driver comprises at least one first transistor, a voltage supply terminal for providing a driving voltage to drive LEDs, and a bleeder circuit. Each of the at least one first transistor has an input terminal coupled to the LEDs and lights up or turns off the LEDs. The bleeder circuit detects a voltage of an output terminal of each the at least one first transistor and the power voltage. The bleeder circuit will generate a bleeder current to discharge the voltage supply terminal when the voltage of the output terminal of each the at least one first transistor is lower than a first threshold and the power voltage is higher than a second threshold, thereby preventing the LEDs from flickering. Wherein, the bleeder circuit detects the voltage of the output terminal of each the at least one first transistor. Thus, whether the LEDs are lighted can be confirmed. As a result, the bleeder current can be prevented from being generated during the LEDs turned on.

According to the present invention, a method for controlling the linear LED driver comprises the steps of: providing a power voltage used by the linear LED driver; and generating a bleeder current to discharge voltage supply terminal which is providing a driving voltage to drive LEDs when the voltage of the output terminal of each at least one first transistor is lower than a first threshold and the power voltage is higher than a second threshold, thereby the LEDs can be prevented from flickering. Wherein, each of the at least one first transistor has an input terminal coupled to the LEDs. The present invention detects the voltage of the output terminal of each the at least one first transistor to realize whether the LEDs are lighted. Preferably, the bleeder current can be prevented from being generated during the LEDs turned on.

BRIEF DESCRIPTION OF THE DRAWINGS

These and other objectives, features and advantages of the present invention will become apparent to those skilled in the art upon consideration of the following description of the preferred embodiments according to the present invention taken in conjunction with the accompanying drawings, in which.

DETAILED DESCRIPTION OF THE INVENTION

Figure 1:
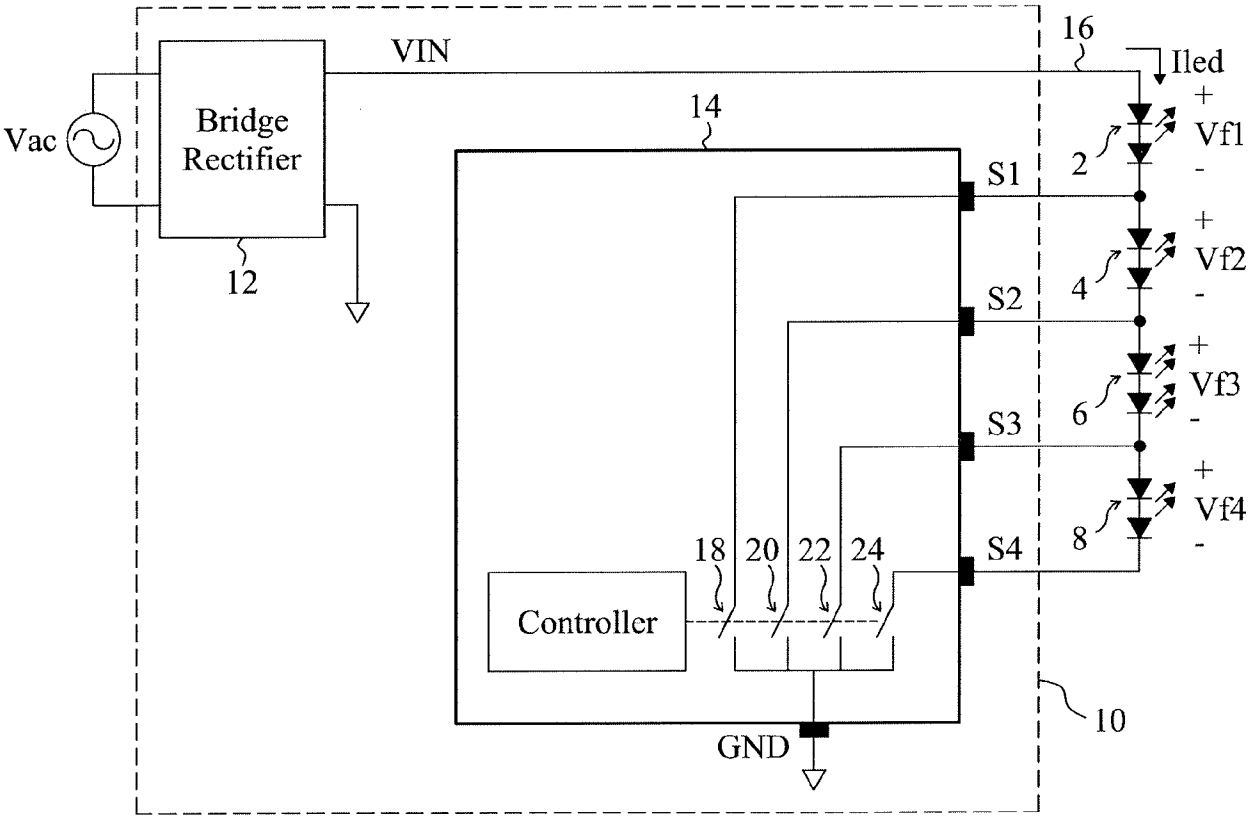
Fig. 1 Prior Art
FIG. 1 shows a conventional linear LED driver of non-isolated type.
Figure 2:
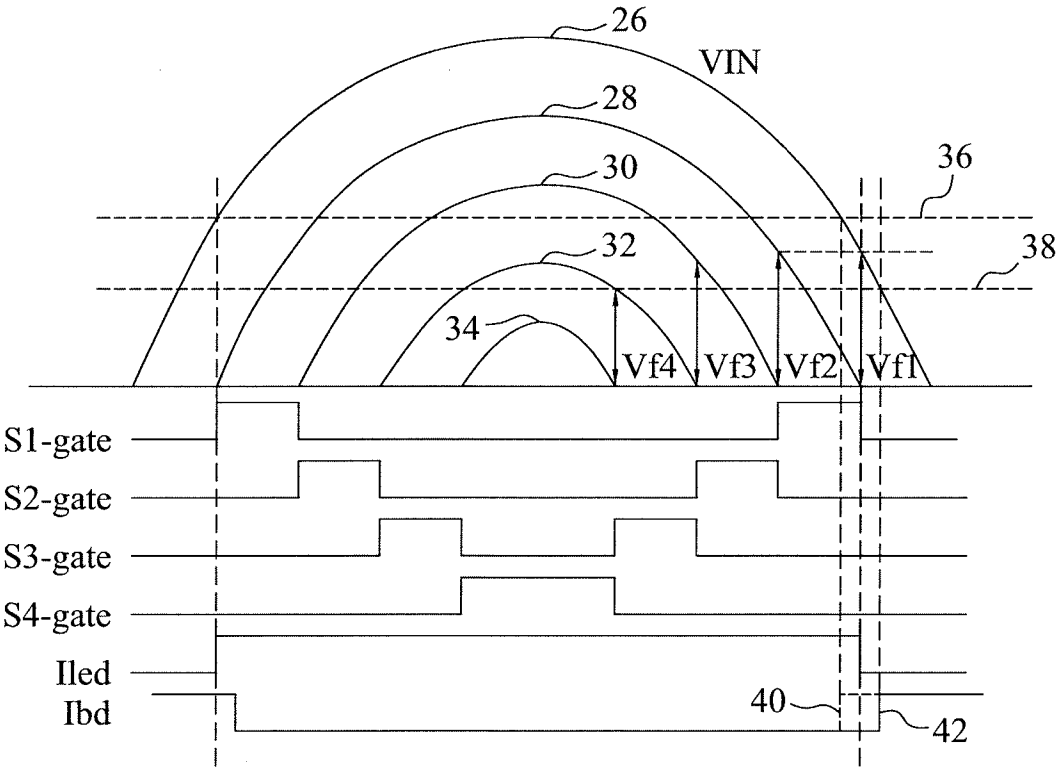
Fig. 2 Prior Art
FIG. 2 shows waveforms of signals generated by the circuit shown in FIG. 1.
Figure 3:
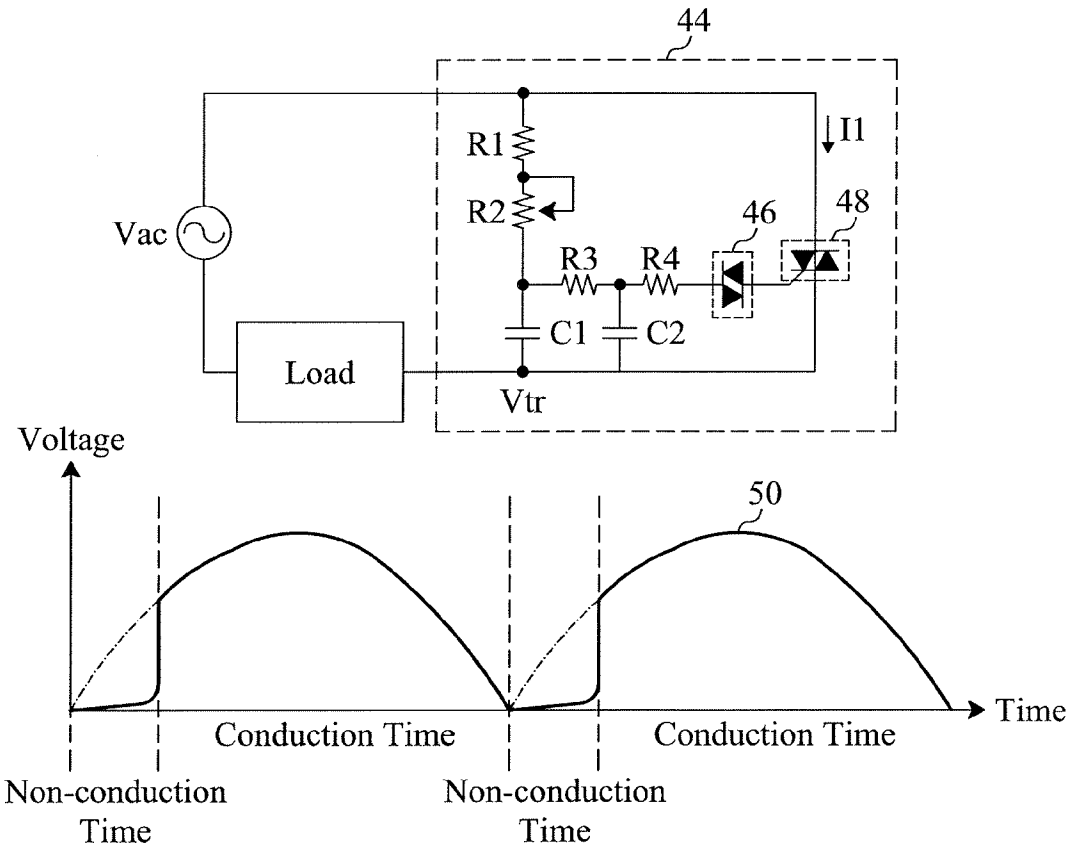
Fig. 3 Prior Art
FIG. 3 shows a conventional TRIAC dimmer.
Figure 4:
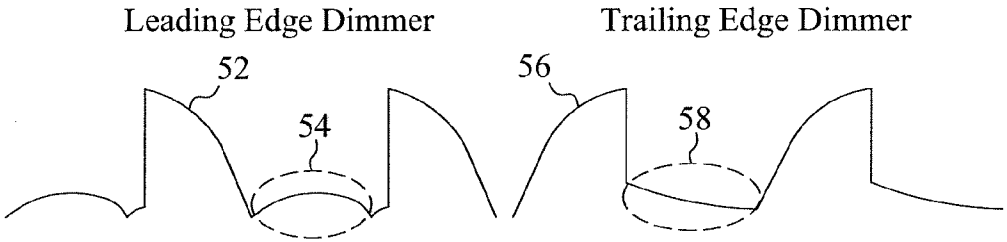
Fig. 4 Prior Art
FIG. 4 shows a waveform of a driving voltage VIN generated by the conventional TRIAC dimmer shown in FIG. 3.
Figure 5:
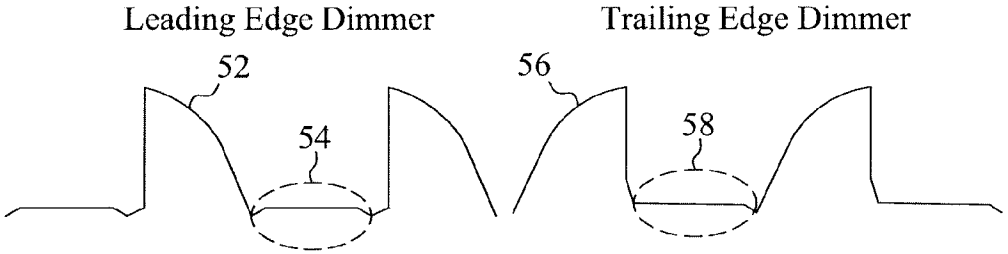
Fig. 5 Prior Art
FIG. 5 shows a waveform of the driving voltage VIN if using a bleeder circuit.
Figure 6:
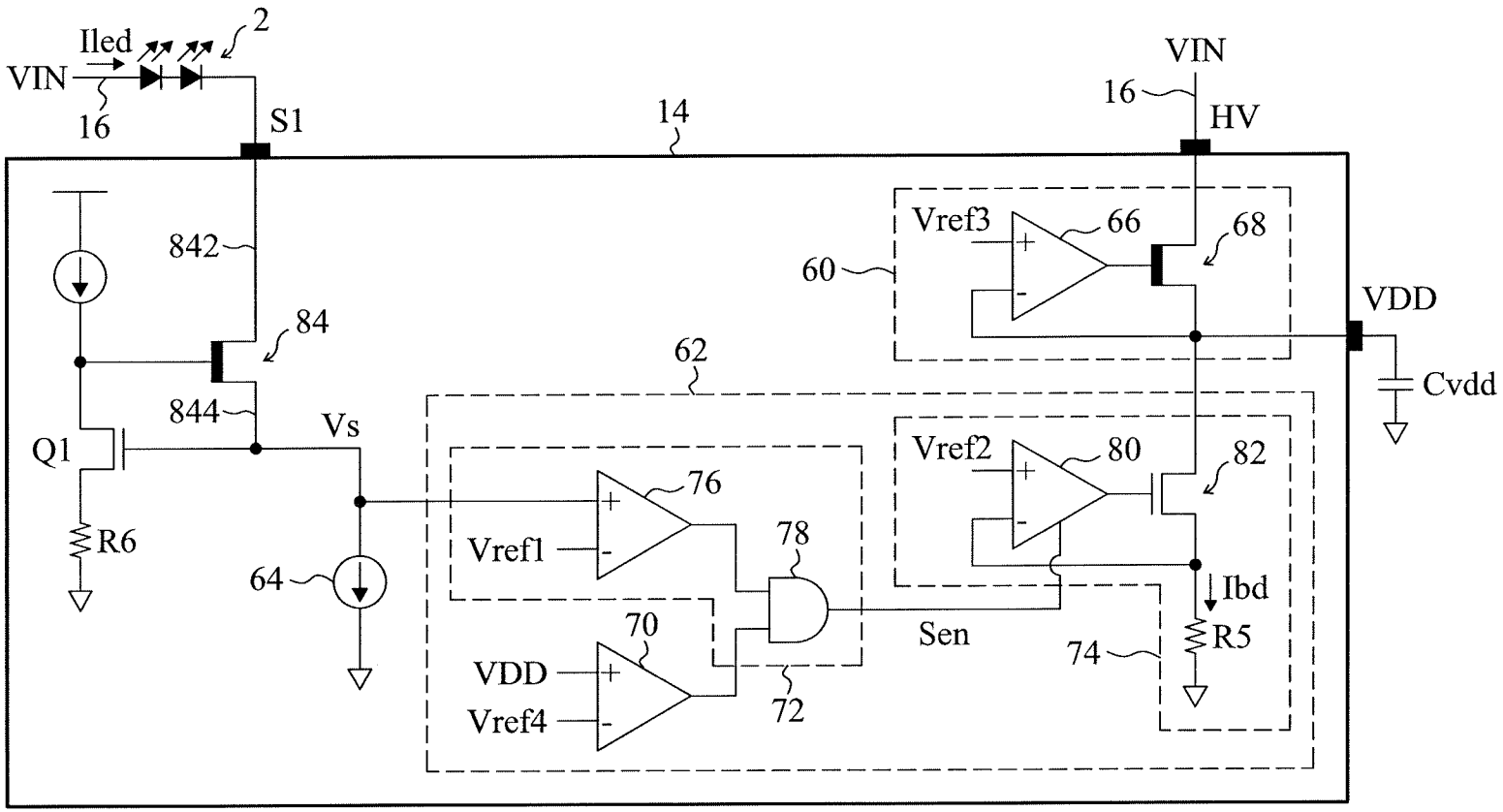
FIG. 6 shows a first embodiment of the present invention.

FIG. 6 shows a first embodiment of the present invention. FIG. 6 only shows a control circuit in an IC 14. Other parts of the linear LED driver 10 can be referred to FIGS. 1 and 3. The IC 14 in FIG. 6 comprises a voltage regulator 60, a bleeder circuit 62, a current source 64 and a transistor 84. The transistor 84 includes an input terminal 842 coupled to an LED 2 via a pin S1. The switching of the transistor 84 controls the LED 2 to be lighted up or turned off. The transistor 84 adopts a high-voltage component such as the metal-oxide-semiconductor field effect transistor (MOSFET) or the insulated gate bipolar transistor (IGBT). The current source 64 is coupled to an output terminal 844 of the transistor 84 for regulating a current Iled that goes through the LED 2. The voltage regulator 60 is coupled to a voltage supply terminal 16 via a pin HV, thereby converting a driving voltage VIN into a power voltage VDD used by the linear LED driver 10. The voltage regulator 60 includes an operation amplifier 66 and a transistor 68. An input terminal of the transistor 68 is coupled to the voltage supply terminal 16 and an output terminal of the transistor 68 provides the power voltage VDD. The operation amplifier 66 detects the power voltage VDD and controls a voltage of a control terminal of the transistor 68 according to a difference between the power voltage VDD and a threshold Vref3, thereby regulating the power voltage VDD. The bleeder circuit 62 is coupled to the output terminal 844 of the transistor 84 and the voltage regulator 60. When a voltage Vs of the output terminal 844 of the transistor 84 is lower than a threshold Vref1 and the power voltage VDD is higher than a threshold Vref4, the bleeder circuit 62 will generate a bleeder current Ibd to discharge to the voltage supply terminal 16 via the voltage regulator 60. Accordingly, the LED 2 can be prevented from flickering. The bleeder circuit 62 includes a comparator 70, a detecting circuit 72, and a current source 74. The current source 74 is coupled to the output terminal of the transistor 68 and is providing the bleeder current Ibd. The current source 74 includes a transistor 82 and a resistor R5 serially connected between the output terminal of the transistor 68 and a ground. An operation amplifier 80 includes a positive input terminal for receiving the threshold Vref2 and a negative input terminal coupled to the resistor R5 and a control terminal of the transistor 82. According to a principle of virtual ground, the operation amplifier 80 puts the threshold Vref2 on the resistor R5 so as to generate the bleeder current Ibd. The detecting circuit 72 is coupled to the current source 74 and is detecting the voltage Vs of the output terminal 844 of the transistor 84. The detecting circuit 72 will generate an enable signal Sen to enable the operation amplifier 80 so as to enable the current source 74 when the voltage Vs of the output terminal 844 of the transistor 84 is lower than the threshold Vref1. The detecting circuit 72 includes a comparator 76 and an AND gate 78. The comparator 76 compares the voltage Vs of the output terminal 844 of the transistor 84 with the threshold Vref1. When the voltage Vs is lower than the threshold Vref1, which is meaning that the LED 2 is turned off, the comparator 76 will sends the enable signal Sen to enable the current source 74 via the AND gate 78. The comparator 70 includes two input terminals that receive the power voltage VDD and the threshold Vref4, respectively. The comparator 70 also includes an output terminal coupled to the detecting circuit 72. When the power voltage VDD is lower than the threshold Vref4, the comparator 70 generates a comparing signal to the AND gate 78 of the detecting circuit 72, thereby ending the enable signal Sen so as to turn off the current source 74. In this embodiment, the bleeder circuit 62 utilizes the inherent pin HV and the high-voltage component (transistor 68) in the voltage regulator 60 to separate the high voltage and draw the bleeder current. Thus, the present invention does not need extra high-voltage components or pins, which conduces to a lower cost.

Figure 7:
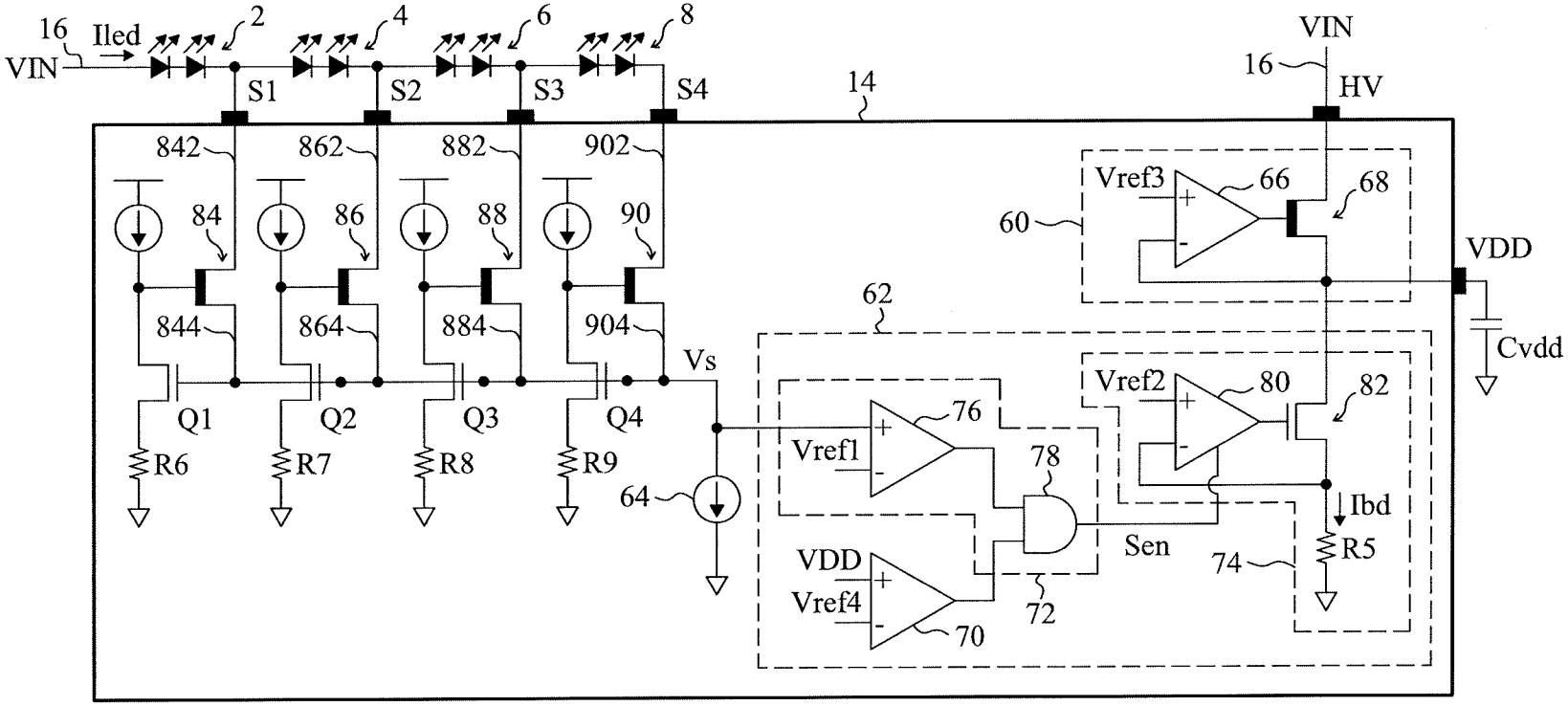
FIG. 7 shows a second embodiment of the present invention.

FIG. 7 shows a second embodiment of the present invention. This embodiment comprises the same voltage regulator 60, bleeder circuit 62, and current source 64 as those in FIG. 6. Differently, in FIG. 7, besides the transistor 84, the second embodiment further comprises transistors 86, 88, and 90 for controlling LEDs 4, 6, and 8, respectively. In FIG. 7, an input terminal 862 of the transistor 86 is coupled to the LED 4, an input terminal 882 of the transistor 88 is coupled to the LED 6, and an input terminal 902 of the transistor 90 is coupled to the LED 8. An output terminal 864 of the transistor 86, an output terminal 884 of the transistor 88, and an output terminal 904 of the transistor 90 are connected together and coupled to the detecting circuit 72.

Figure 8:
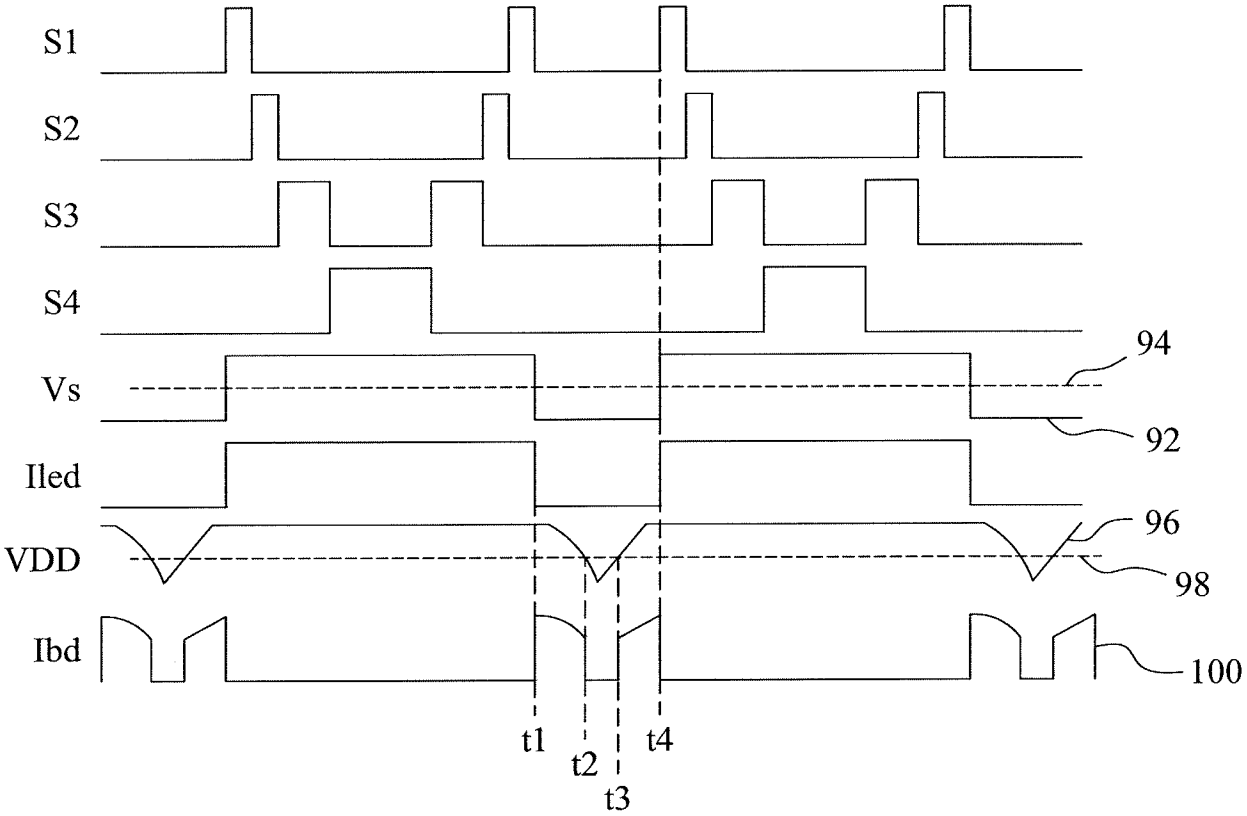
FIG. 8 shows a waveform of signals of the circuit without the TRIAC dimming in FIG. 7.

FIG. 8 shows waveforms of signals of the circuit without TRIAC dimming in FIG. 7, in which the waveform 92 represents the voltage Vs, the waveform 94 represents the threshold Vref1, the waveform 96 represents the power voltage VDD, the waveform 98 represents the threshold Vref4, and the waveform 100 represents the bleeder current Ibd. Referring to FIGS. 7 and 8, when the transistors 84, 86, 88, and 90 are all turned off to make that the LEDs 2, 4, 6, and 8 are all turned off, as shown by time t1 in FIG. 8, the voltage Vs on output terminals 844, 864, 884, and 904 of the transistors 84, 86, 88, and 90 will lower than the threshold Vref1, as shown by the waveforms 92 and 94. Accordingly, the detecting circuit 72 sends the enable signal Sen for enabling the current source 74 to generate the bleeder current Ibd so as to discharge the voltage supply terminal 16, thereby preventing the LEDs 2, 4, 6, and 8 from flickering. At the same time, the capacitor Cvdd also discharged by the bleeder current Ibd, which causes the power voltage VDD to be lowered. Wherein, when the power voltage VDD is too low, the linear LED driver 10 might be not operated properly. In order to prevent such situation, when the power voltage VDD is lower than the threshold Vref4 as shown by time t2 in FIG. 8, the comparator 70 will sends the comparing signal to the detecting circuit 78 to end the enable signal Sen so as to turn off the current source 74 to cease the bleeder current Ibd. When the power voltage VDD recovers and is higher than a level of the threshold Vref4 and the voltage Vs is still lower than the threshold Vref1, as shown by time t3 in FIG. 8, the current source 74 will be enabled again to generate the bleeder current Ibd. When the driving voltage VIN rises to turn on the transistor 84 as shown by time t4 in FIG. 8, the voltage Vs rises and is higher than the threshold Vref1. At this time, the detecting circuit 72 stops outputting the enable signal Sen immediately, thereby turning off the current source 74 to cease the bleeder current Ibd.

Figure 9:
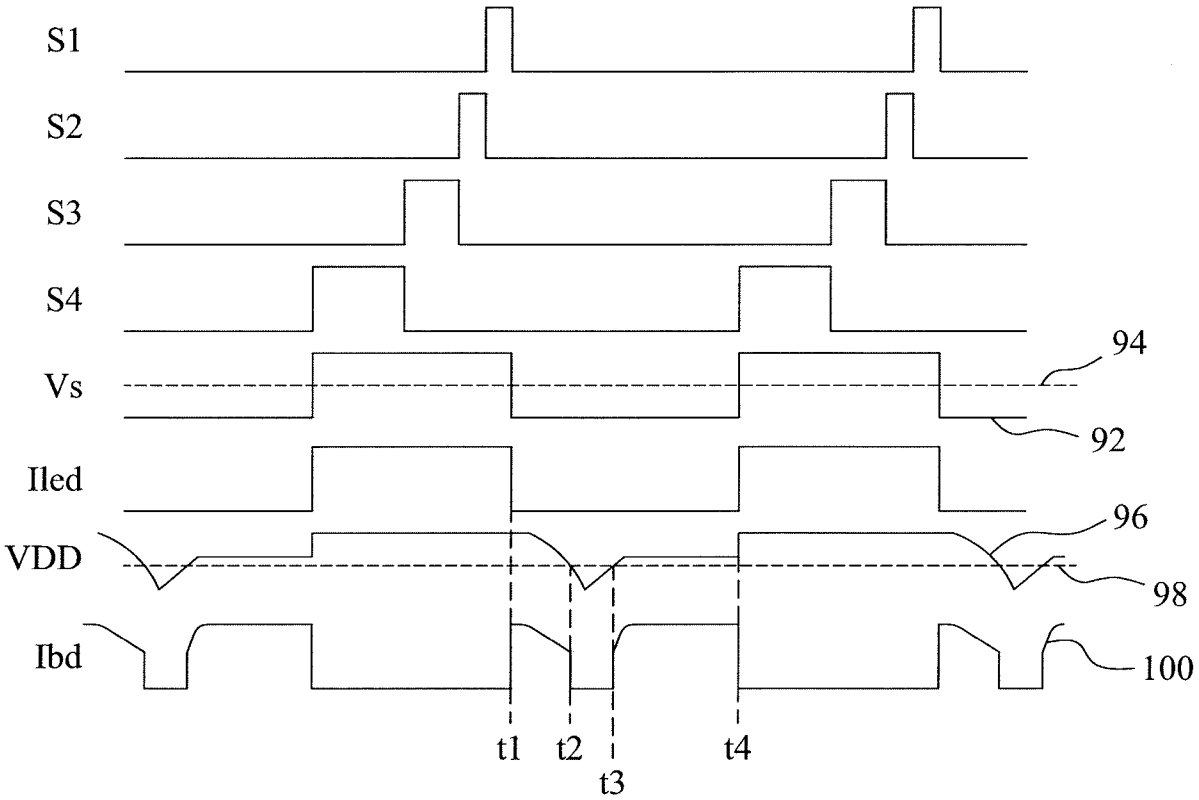
FIG. 9 shows a waveform of signals of the circuit with the TRIAC dimming in FIG. 7.

FIG. 9 shows waveforms of signals of the circuit with TRIAC dimming in FIG. 7. Referring to FIGS. 7 and 9, when the transistors 84, 86, 88, and 90 are all turned off to make that the LEDs 2, 4, 6, and 8 are all turned off as shown by time t1 in FIG. 9, the voltage Vs will be lower than the threshold Vref1 as shown by waveforms 92 and 94 in FIG. 9. Thus, the detecting circuit 72 sends the enable signal Sen so as to enable the current source 74 to generate the bleeder current Ibd to discharge the voltage supply terminal 16. Accordingly, the LEDs 2, 4, 6, and 8 are prevented from flickering. At the same time, the power voltage VDD starts descending. If the power voltage VDD is too low, the linear LED driver 10 might be not operated properly. In order to avoid such situation, when the power voltage VDD is lower than the threshold Vref4 as shown by time t2 in FIG. 9, the comparator 70 sends the comparing signal to the detecting circuit 78 to end the enable signal so as to turn off the current source 74 to cease the bleeder current Ibd. When the power voltage VDD recovers and is higher than the level of the threshold Vref4 and the voltage Vs is still lower than the threshold Vref1, as shown by time t3 in FIG. 9, the current source 74 will be enabled again to generate the bleeder current Ibd. When the driving voltage VIN rises for turning on the transistor 90 as shown by time t4 in FIG. 9, the voltage Vs rises and is higher than the threshold Vref1. At this time, the detecting circuit 72 stops outputting the enable signal Sen immediately, thereby turning off the current source 74 to cease the bleeder current Ibd.

Referring to waveforms in FIGS. 8 and 9, the present invention judges whether the LEDs 2, 4, 6, and 8 are all turned off or not by detecting the voltage Vs. When the LEDs 2, 4, 6, and 8 are all turned off, the bleeder current Ibd will be generated right away. When one of the LEDs 2, 4, 6, and 8 is turned on, the bleeder current Ibd will be stopped immediately. Thus, the LEDs 2, 4, 6, and 8 are prevented from flickering. Moreover, the bleeder current Ibd will not be generated to lower efficiency while any one of the LEDs 2, 4, 6, and 8 is conductive.

Figure 10:
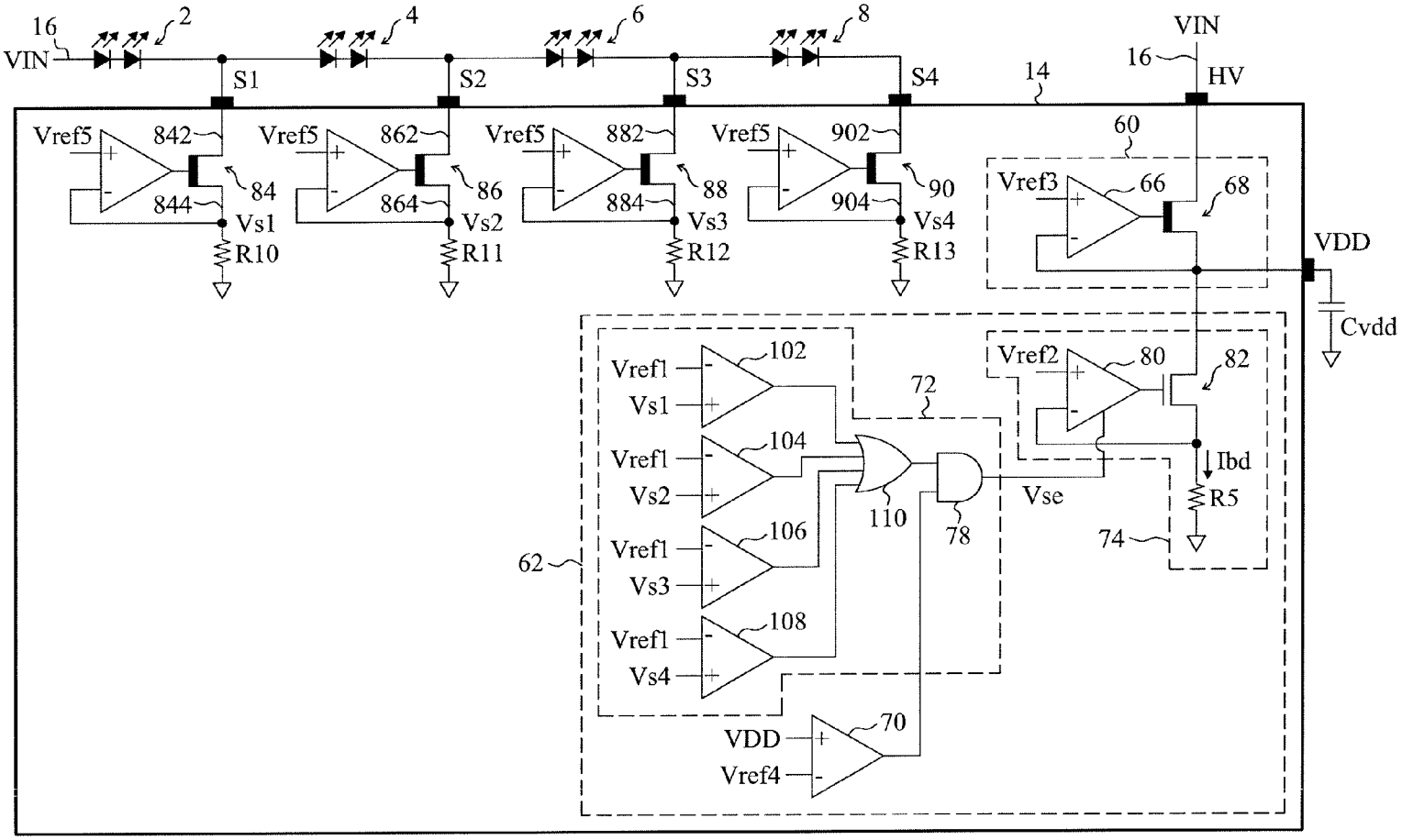
FIG. 10 shows a third embodiment of the present invention.

FIG. 10 shows a third embodiment of the present invention. Similar to that of FIG. 7, the circuit in FIG. 10 also comprises the transistors 84, 86, 88, and 90 for respectively controlling the LEDs 2, 4, 6, and 8, the voltage regulator 60 for converting the driving voltage VIN into the power voltage VDD, and the bleeder circuit 62 for providing the bleeder current. Differently, the detecting circuit 72 of the bleeder circuit 62 in FIG. 10 utilizes more than one comparators 102, 104, 106, and 108 to detect a voltage Vs1 of the output terminal 844 of the transistor 84, a voltage Vs2 of the output terminal 864 of the transistor 86, a voltage Vs3 of the output terminal 884 of the transistor 88, and a voltage Vs4 of the output terminal of the transistor 90, respectively. Moreover, the detecting circuit 72 in this embodiment also utilizes an OR gate 110 to handle the outputs of the comparators 102, 104, 106, and 108, thereby determining whether to enable the current source 74 to generate the bleeder current Ibd. When the voltages Vs1, Vs2, Vs3, and Vs4 are all lower than the threshold Vref1, it is meaning that the LEDs 2, 4, 6, and 8 are all turned off. At this time, the OR gate 110 provides the enable signal Vse to enable the current source 74 via the AND gate 78. Accordingly, the current source 74 will generate the bleeder current Ibd to discharge the voltage supply terminal 16 via the voltage regulator 60, thereby preventing the LEDs 2, 4, 6, and 8 from flickering. Moreover, in order to avoid an over-low power voltage VDD, when the power voltage VDD is lower than the threshold Vref4, the comparator 70 will send the comparing signal to the AND gate 78 to end the enable signal Vse so as to turn off the current source 74. While any one of the voltages Vs1, Vs2, Vs3, and Vs4 is higher than the threshold Vref1, the OR gate 110 stops outputting the enable signal Vse, thereby avoiding generating the bleeder current Ibd to lower efficiency during the LED 2, 4, 6, or 8 turned on.

Figure 11:
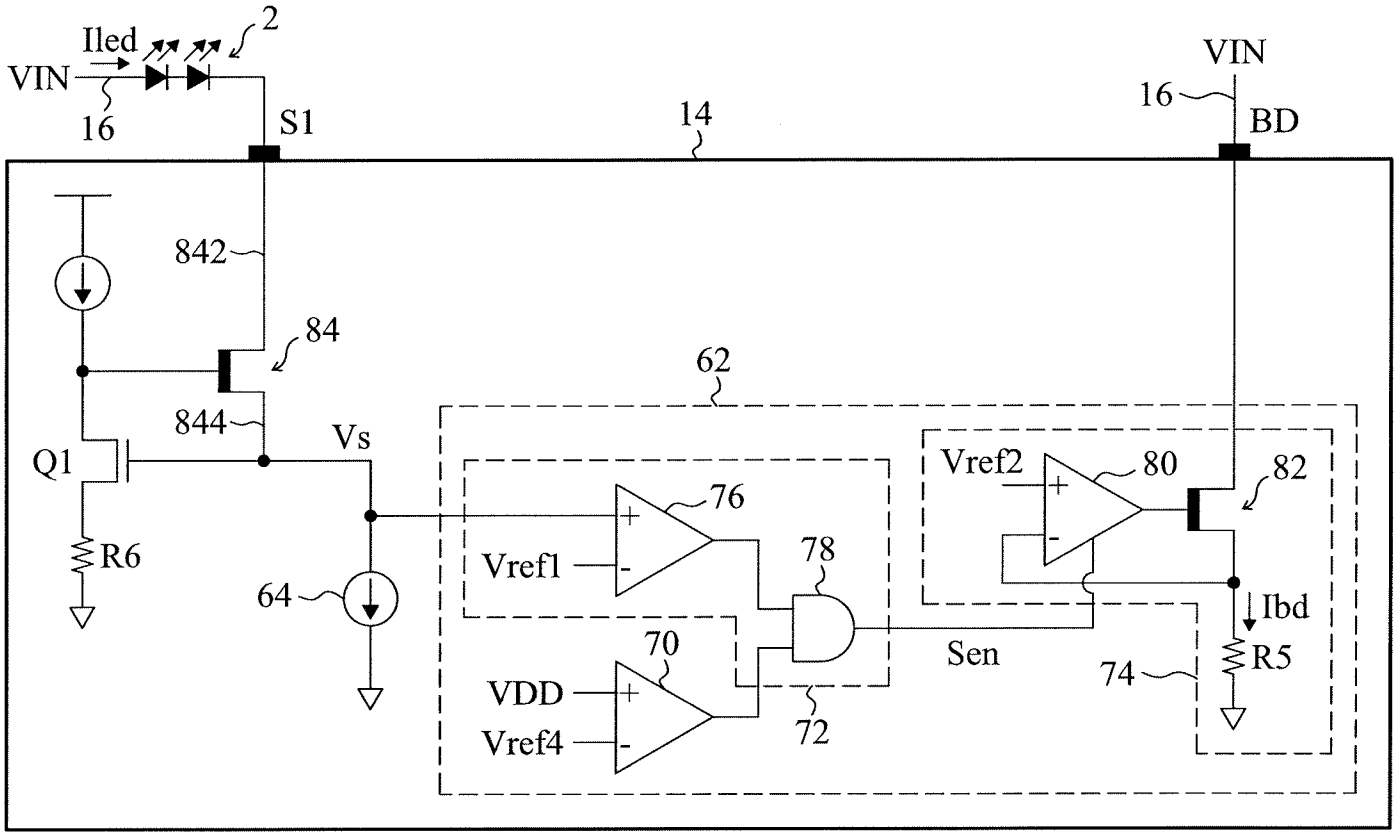
FIG. 11 shows a fourth embodiment of the present invention.

FIG. 11 shows a fourth embodiment of the present invention. The circuit of FIG. 11 is similar to that of FIG. 6. Differently, the bleeder circuit 62 in FIG. 11 is not coupled to the voltage supply terminal 16 via the voltage regulator 66 and the pin HV. The bleeder circuit 62 in this embodiment is directly coupled to the voltage supply terminal 16 via another pin BD. The bleeder circuit 62 directly bears the driving voltage VIN which is a high voltage, so the transistor 82 of the current source 74 in the bleeder circuit 62 has to adopt a high-voltage component. The operation of the circuit in FIG. 11 is also similar to that in FIG. 6. When the voltage Vs of the output terminal 844 of the transistor 84 is lower than the threshold Vref1, it is meaning that the LED 2 is turned off. At this time, the detecting circuit 72 generates an enable signal Sen to enable the current source 74 so as to generate the bleeder current Ibd to prevent the LED 2 from flickering. When the power voltage VDD is lower than the threshold Vref4, the comparator 70 generates a comparing signal to the AND gate 78 of the detecting circuit 72 to end the enable signal Sen, thereby turning off the current source 74. When the transistor 82 is turned on to light up the LED 2, the voltage Vs will be higher than the threshold Vref1 so as to cease the enable signal Sen.

Figure 12:
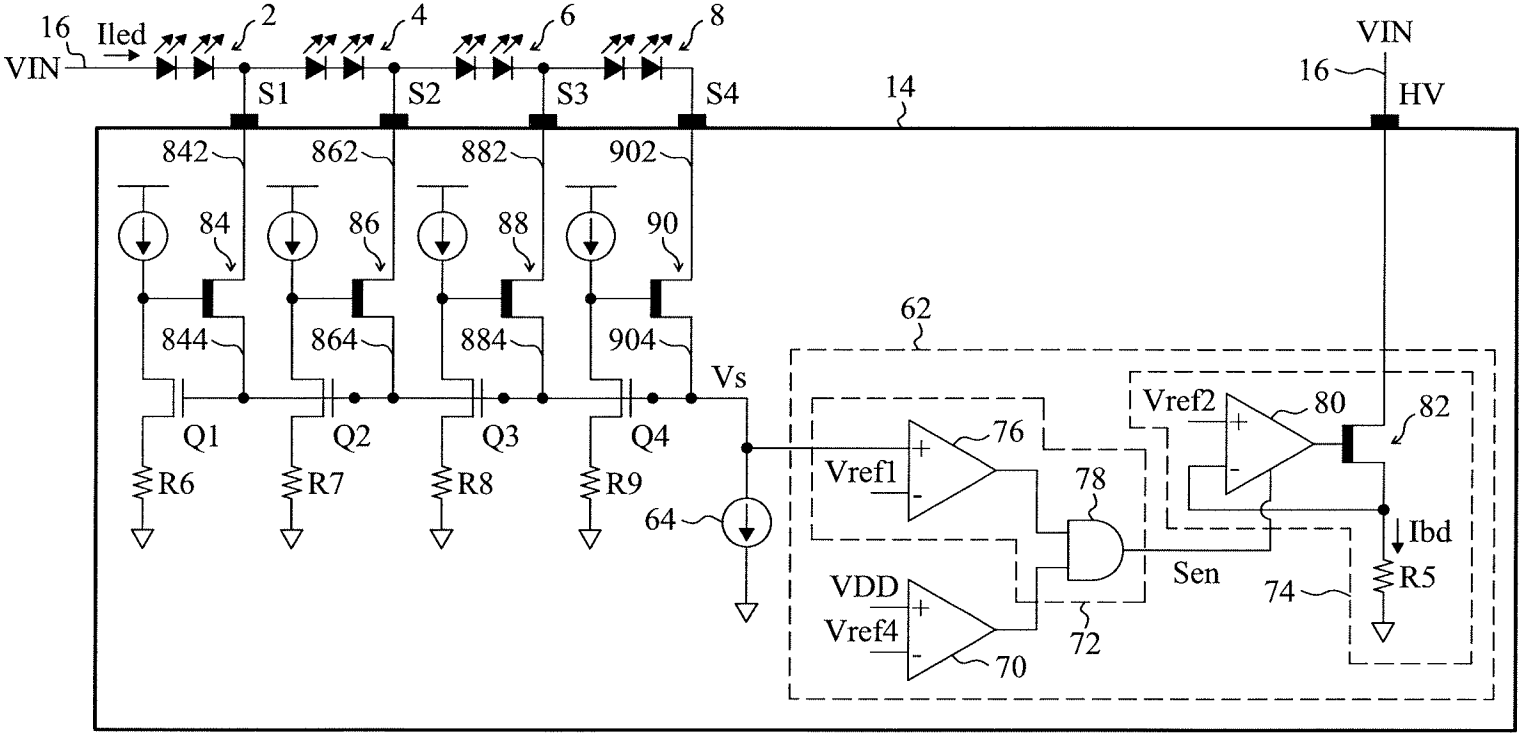
FIG. 12 shows a fifth embodiment of the present invention.

FIG. 12 shows a fifth embodiment of the present invention. The circuit of FIG. 12 is similar to that of FIG. 7. Differently, the bleeder circuit 72 in FIG. 12 is not coupled to the voltage supply terminal 16 via the voltage regulator 66 and the pin HV. The bleeder circuit 62 in FIG. 12 is directly coupled to the voltage supply terminal 16 via another pin BD. Wherein, the bleeder circuit 62 directly bears the driving voltage VIN which is a high voltage, so the transistor 82 of the current source 74 in the bleeder circuit 62 has to adopt a high-voltage component. The operation of the circuit in FIG. 12 is also similar to that in FIG. 7. When the voltage Vs of the input terminal of the comparator 76 is lower than the threshold Vref1, it is meaning that the LEDs 2, 4, 6, and 8 are all turned off. Thus, the detecting circuit 72 generates an enable signal Sen to enable the current source 74, thereby generating the bleeder current Ibd to prevent the LEDs 2, 4, 6, and 8 from flickering. When the power voltage VDD is lower than the threshold Vref4, the comparator 70 generates a comparing signal to the AND gate 78 of the detecting circuit 72 so as to end the enable signal Sen to turn off the current source 74. When any one of the transistors 84, 86, 88, and 90 is turned on for lighting up the correspondent LED, the voltage Vs will be higher than the threshold Vref1, thereby ceasing the enable signal Sen.

Figure 13:
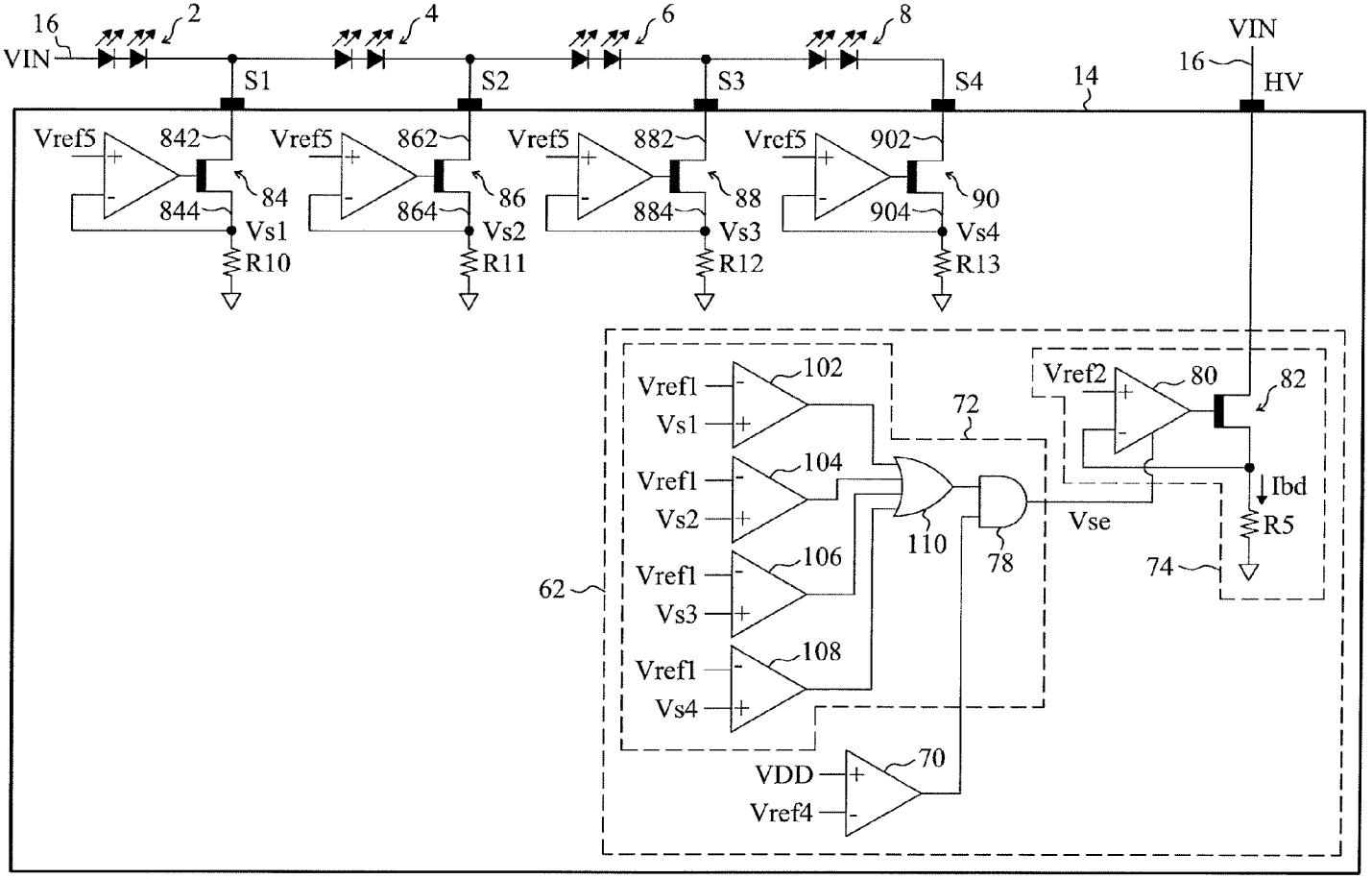
FIG. 13 shows a sixth embodiment of the present invention.

FIG. 13 shows a sixth embodiment of the present invention. The circuit of FIG. 13 is similar to that of FIG. 10. Differently, the bleeder circuit 62 in FIG. 13 is not coupled to the voltage supply terminal 16 via the voltage regulator 66 and the pin HV. The bleeder circuit 62 in FIG. 13 is directly coupled to the voltage supply terminal 16 via another pin BD. Wherein, the bleeder circuit 62 directly bears the driving voltage VIN which is a high voltage, so the transistor 82 of the current source 74 in the bleeder circuit 62 has to adopt a high-voltage component. The operation of the circuit in FIG. 13 is also similar to that in FIG. 10. The comparators 102, 104, 106, and 108 detect the voltage Vs1 of the output terminal 844 of the transistor 84, the voltage Vs2 of the output terminal 864 of the transistor 86, the voltage Vs3 of the output terminal 884 of the transistor 88, and the voltage Vs4 of the output terminal of the transistor 90, respectively. When the voltages Vs1, Vs2, Vs3, Vs4 are all lower than the threshold Vref1, it is meaning that the LEDs 2, 4, 6, and 8 are all turned off. At this time, the detecting circuit 72 generates an enable signal Vse to enable the current source 74, thereby providing the bleeder current Ibd to discharge the voltage supply terminal 16 so as to prevent the LEDs 2, 4, 6, and 8 from flickering. When the power voltage VDD is lower than the threshold Vref4, the comparator 70 will generate a comparing signal to the detecting circuit 72 to end the enable signal Vse so as to turn off the current source 74. When any one of voltages Vs1, Vs2, Vs3, and Vs4 is higher than the threshold Vref1, the detecting circuit 72 stops outputting the enable signal Vse so as to cease the bleeder current Ibd.

Figure 14:
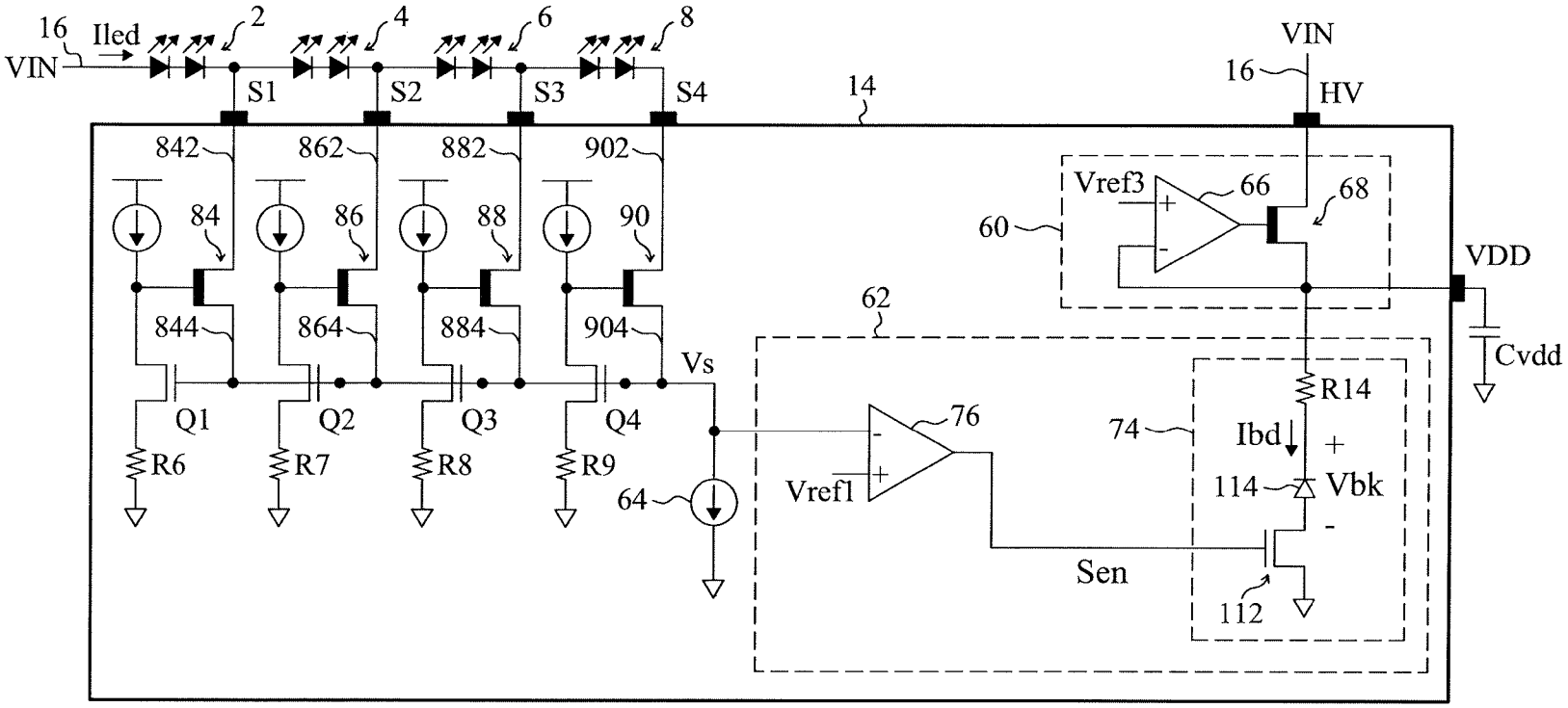
FIG. 14 shows a seventh embodiment of the present invention.

FIG. 14 shows a seventh embodiment of the present invention. Except the bleeder circuit 62, other circuit and operation in this embodiment are the same as those in FIG. 7. The bleeder circuit 62 in FIG. 14 includes the comparator 76 and the current source 74. The comparator 76 compares the voltage Vs with the threshold Vref1. When the voltage Vs is lower than the threshold Vref1, it is meaning that the LEDs 2, 4, 6, and 8 are all turned off. At this time, the comparator 76 sends an enable signal Sen for enabling the current source 74 to generate a bleeder current Ibd to discharge the voltage supply terminal 16 via the voltage regulator 60. Accordingly, the LEDs 2, 4, 6, and 8 are prevented from flickering. The current source 74 includes a transistor 112, a diode 114, and a resistor R14 serially connected between the voltage regulator 60 and a ground. When the transistor 112 is turned on by the enable signal Sen, the diode 114 provides a threshold Vbk (a breakdown voltage of the diode 114). When the power voltage VDD is higher than the threshold Vbk, the resistor R14 generates the bleeder current Ibd=(VDD-Vbk)/R14 according to a difference between the power voltage VDD and the threshold Vbk. The bleeder current Ibd will discharge the voltage supply terminal 16 via the voltage regulator 60. In this embodiment, the bleeder current Ibd will decrease with the decrease of the power voltage VDD. When the power voltage VDD equals to or is lower than the threshold Vbk, the current source 74 will stop generating the bleeder current Ibd so as to avoid an over-low power voltage VDD.

Figure 15:
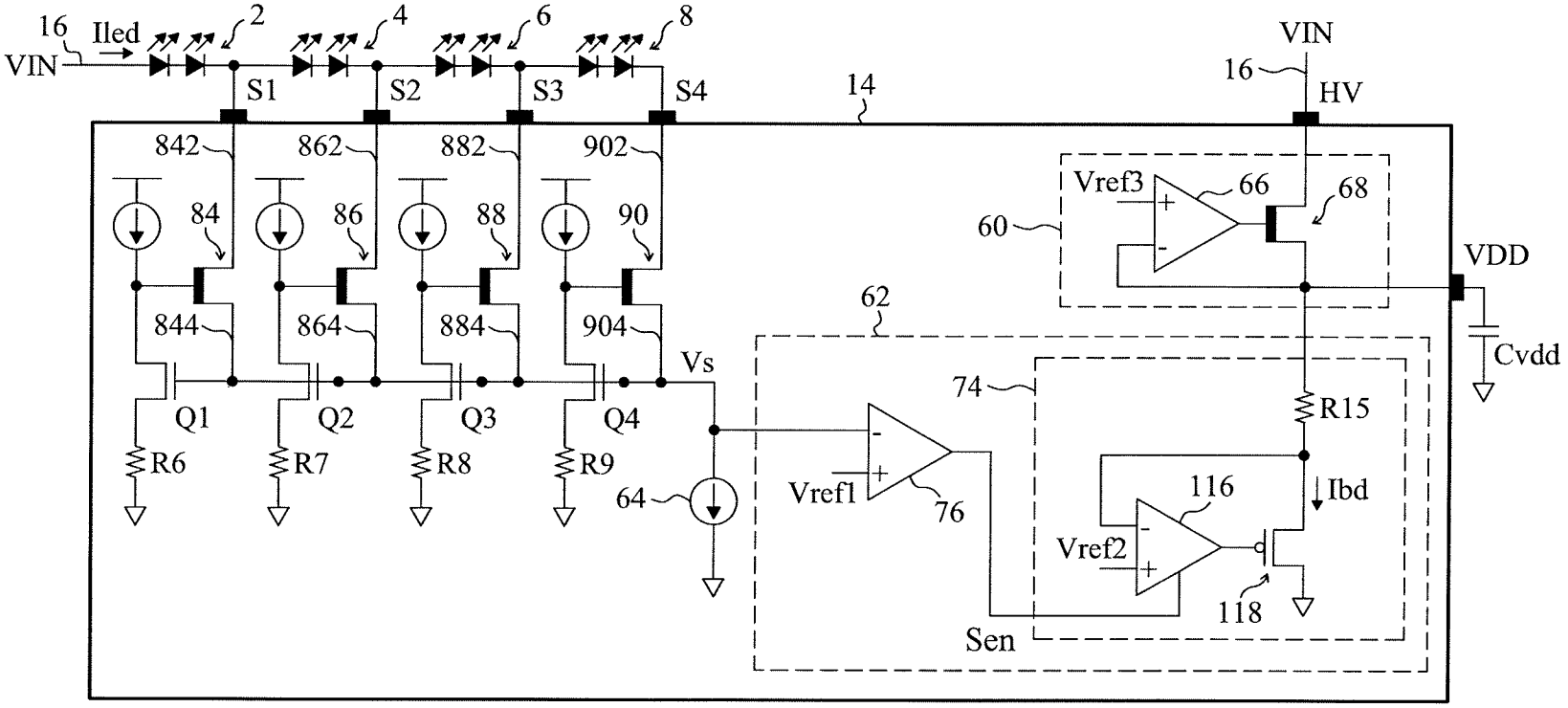
FIG. 15 shows an eighth embodiment of the present invention.

FIG. 15 shows an eighth embodiment of the present invention. Except the bleeder circuit 62, other circuit and operation in this embodiment are the same as those in FIG. 7. The bleeder circuit 62 in FIG. 15 includes the comparator 76 and the current source 74. The comparator 76 compares the voltage Vs with the threshold Vref1. When the voltage Vs is lower than the threshold Vref1, it is meaning that the LEDs 2, 4, 6, and 8 are all turned off. At this time, the comparator 76 sends an enable signal Sen for enabling the current source 74 so as to generate a bleeder current Ibd to discharge the voltage supply terminal 16 via the voltage regulator 60. Accordingly, the LEDs 2, 4, 6, and 8 are prevented from flickering. The current source 74 includes an operation amplifier 116, a transistor 118, and a resistor R15. A first terminal of the resistor R15 receives the power voltage VDD, and a negative input terminal of the operation amplifier 116 is coupled to a second terminal of the resistor R15. A positive input terminal of the operation amplifier 116 receives the threshold Vref2. An output terminal of the operation amplifier 116 is coupled to a control terminal of the transistor 118. An input terminal and an output terminal of the transistor 118 are coupled to the second terminal of the resistor R15 and a ground, respectively. When the operation amplifier 116 is enabled by the enable signal Sen, the operation amplifier 116 will turn on the transistor 118. At the same time, according to the principle of virtual ground, the threshold Vref2 of the positive input terminal of the operation amplifier 116 is put on the second terminal of the resistor R15. At this time, the resistor R15 generates the bleeder current Ibd=(VDD−Vref2)/R15 according to a difference between the power voltage VDD and the threshold Vref2, and the bleeder current Ibd will discharge the voltage supply terminal 16 via the voltage regulator 60. In this embodiment, the bleeder current Ibd will decrease with the decrease of the power voltage VDD. When the power voltage VDD equals to or is lower than the threshold Vref2, the current source 74 will stop generating the bleeder current Ibd so as to avoid an over-low power voltage VDD.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A linear light emitting diode (LED) driver, comprising:

at least one first transistor, each of which has an input terminal coupled to a LED and is configured to operably light up or turn off the LED;

a voltage supply terminal coupled to the LED and configured to operably provide a driving voltage to drive the LED;

a voltage regulator coupled to the voltage supply terminal and configured to operably convert the driving voltage into a power voltage used by the linear LED driver; and a bleeder circuit coupled to the output terminal of each the at least one first transistor and the voltage regulator, configured to operably generate a bleeder current to discharge the voltage supply terminal via the voltage regulator so as to prevent the LED from flickering when a voltage of the output terminal of each the at least one first transistor is lower than a first threshold and the power voltage is higher than a second threshold.

2. The linear LED driver of claim 1, wherein the at least one first transistor will be turned on or turned off according to a level of the driving voltage.

3. The linear LED driver of claim 1, wherein the at least one first transistor is an insulated gate bipolar transistor or a metal-oxide-semiconductor field effect transistor.

4. The linear LED driver of claim 1, wherein the voltage regulator includes:

a second transistor having an input terminal coupled to the voltage supply terminal and an output terminal for providing the power voltage; and an operation amplifier coupled to a control terminal of the second transistor and configured to operably detect the power voltage to control a voltage of the control terminal of the second transistor so as to regulate the power voltage.

5. The linear LED driver of claim 1, wherein the bleeder circuit includes:

a current source coupled to the voltage supply terminal via the voltage regulator and configured to operably provide the bleeder current;

a detecting circuit coupled to the current source, configured to operably detect the voltage of the output terminal of each the at least one first transistor and configured to operably generate an enable signal to enable the current source when the voltage of the output terminal of each the at least one first transistor is lower than the first threshold; and a comparator having two input terminals for receiving the power voltage and the second threshold, respectively, and an output terminal coupled to the detecting circuit, configured to operably generate a comparing signal for the detecting circuit to end the enable signal so as to turn off the current source when the power voltage is lower than the second threshold.

6. The linear LED driver of claim 1, wherein bleeder circuit includes:

a comparator configured to operably compare the voltage of the output terminal of each the at least one transistor with the first threshold and generate an enable signal when the voltage of the output terminal of each the at least one first transistor is lower than the first threshold; and a current source coupled to the comparator and coupled to the voltage supply terminal via the voltage regulator, configured to operably provide the bleeder current when the current source is enabled by the enable signal and the power voltage is higher than the second threshold;

wherein the bleeder current will decrease when the power voltage decreases.

7. The linear LED driver of claim 6, wherein the current source includes a resistor, a diode, and a second transistor that are serially connected, in which the diode will provide the second threshold when the second transistor is turned on by the enable signal and the resistor generates the bleeder current according to a difference between the power voltage and the second threshold.

8. The linear LED driver of claim 6, wherein the current source includes:

a second transistor;

a resistor having a first terminal which is configured to operably receive the power voltage and a second terminal coupled to an input terminal of the second transistor;

an operation amplifier having a first input terminal which is configured to operably receive the second threshold, a second input terminal coupled to the second terminal of the resistor, and an output terminal coupled to a control terminal of the second transistor;

wherein, when the operation amplifier is enabled by the enable signal, the operation amplifier turns on the second transistor and puts the second threshold on the second terminal of the resistor, so that the resistor can generate the bleeder current according to a difference between the power voltage and second threshold.

9. A linear light emitting diode (LED) driver comprising:

at least one transistor, each of which has an input terminal coupled to a LED and is configured to operably light up or turn off the LED;

a voltage supply terminal coupled to the LED and configured to operably provide a driving voltage to drive the LED;

a bleeder circuit coupled to the output terminal of each the at least one first transistor and the voltage regulator, configured to operably generate a bleeder current to discharge the voltage supply terminal so as to prevent the LED from flickering when a voltage of the output terminal of each the at least one first transistor is lower than a first threshold and a power voltage of the linear LED driver being higher than a second threshold.

10. The linear LED driver of claim 9, wherein the at least one first transistor will be turned on or turned off according to a level of the driving voltage.

11. The linear LED driver of claim 9, wherein the at least one first transistor is an insulated gate bipolar transistor or a metal-oxide-semiconductor field effect transistor.

12. The linear LED driver of claim 9, wherein the bleeder circuit includes:

a current source coupled to the voltage supply terminal and configured to operably provide the bleeder current;

a detecting circuit coupled to the current source, configured to operably detect the voltage of the output terminal of each the at least one first transistor and configured to operably generate an enable signal to the current source when the voltage of the output terminal of each the at least one first transistor is lower than the first threshold; and a comparator having two input terminals that are configured to operably receive the power voltage and the second threshold, respectively, and an output terminal coupled to the detecting circuit, configured to operably generate a comparing signal to the detecting circuit to end the enable signal so as to turn off the current source when the power voltage is lower than the second threshold.

13. A control method of a linear light emitting diode (LED) driver including a voltage supply terminal configured to operably providing a driving voltage to drive LEDs, and at least one first transistor, each of which has an input terminal coupled to a respective LED, the control method comprising the steps of:

providing a power voltage used by the linear LED driver; and generating a bleeder current to discharge the voltage supply terminal so as to prevent the LEDs from flickering when a voltage of an output terminal of each the at least one first transistor is lower than a first threshold and the power voltage is higher than a second threshold.

14. The control method of claim 13, wherein the step of providing a power voltage includes converting the driving voltage to the power voltage.

15. The control method of claim 13, wherein the step of generating a bleeder current to discharge the voltage supply terminal includes the steps of:

generating an enable signal to enable a current source to generate the bleeder current when the voltage of the output terminal of each the at least one first transistor is lower than the first threshold; and generating a comparing signal to end the enable signal so as to turn off the current source when the power voltage is lower than the second threshold.

16. The control method of claim 13, wherein the step of generating a bleeder current to discharge the voltage supply terminal includes generating the bleeder current according to a difference between the power voltage and the second threshold, wherein the bleeder current will decrease when the power voltage decreases.

* * * * *